US009079294B2

(12) United States Patent
Holmes

(10) Patent No.: US 9,079,294 B2
(45) Date of Patent: Jul. 14, 2015

(54) CONVOLUTE ABRASIVE WHEEL AND METHOD OF MAKING

(75) Inventor: Dean S. Holmes, Ellsworth, WI (US)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 123 days.

(21) Appl. No.: 13/882,564

(22) PCT Filed: Nov. 15, 2011

(86) PCT No.: PCT/US2011/060752

§ 371 (c)(1),
(2), (4) Date: Apr. 30, 2013

(87) PCT Pub. No.: WO2012/068082

PCT Pub. Date: May 24, 2012

(65) Prior Publication Data

US 2013/0225054 A1 Aug. 29, 2013

Related U.S. Application Data

(60) Provisional application No. 61/414,966, filed on Nov. 18, 2010.

(51) Int. Cl.

| | |
|---|---|
| ***B24D 18/00*** | (2006.01) |
| ***B24D 13/02*** | (2006.01) |
| ***B24D 3/02*** | (2006.01) |
| ***B24D 13/12*** | (2006.01) |

(52) U.S. Cl.

CPC *B24D 13/02* (2013.01); *B24D 3/02* (2013.01); *B24D 13/12* (2013.01); *B24D 18/0036* (2013.01)

(58) Field of Classification Search

CPC ..... B24D 5/12; B24D 5/16; B24D 5/066; B24D 18/00; B24D 5/04

USPC ..... 451/526–539, 544; 51/293, 298, 299, 51/307

See application file for complete search history.

(56) References Cited

U.S. PATENT DOCUMENTS

| | | | | |
|---|---|---|---|---|
| 2,335,902 | A | 12/1943 | Ball | |
| 2,958,593 | A | 11/1960 | Hoover | |
| 3,016,294 | A | 1/1962 | Haywood | |
| 3,127,253 | A * | 3/1964 | Smith | 51/293 |
| 3,401,491 | A * | 9/1968 | Schnabel et al. | 51/295 |

(Continued)

FOREIGN PATENT DOCUMENTS

| | | |
|---|---|---|
| CN | 1162283 A | 10/1997 |
| WO | WO 97/05990 | 2/1997 |

(Continued)

OTHER PUBLICATIONS

Lawn, et al., "Equilibrium Penny-like Cracks in Indention Fracture,"*Journal of Material Science*, vol. 10, (1975), pp. 2016-2024.

*Primary Examiner* — George Nguyen

(74) *Attorney, Agent, or Firm* — Scott A. Baum; David B. Patchett

(57) ABSTRACT

A convolute abrasive wheel formed from a spirally wound nonwoven abrasive web. The nonwoven abrasive web including a make coat and abrasive particles having a Vickers indentation hardness of at least 16 Gpa and a toughness of at least 3.0 Mpa $m^{1/2}$. A first size coat comprising a phenolic resin is applied over the make coat and the abrasive prepolymer is applied over the first size coat.

6 Claims, 2 Drawing Sheets

(56) References Cited

U.S. PATENT DOCUMENTS

| | | | | | |
|---|---|---|---|---|---|
| 4,298,356 | A | | 11/1981 | Teschner | |
| 4,314,827 | A | | 2/1982 | Leitheiser | |
| 4,486,200 | A | | 12/1984 | Heyer | |
| 5,250,085 | A | * | 10/1993 | Mevissen | 51/298 |
| 5,482,756 | A | * | 1/1996 | Berger et al. | 428/36.2 |
| 5,498,269 | A | | 3/1996 | Larmie | |
| 5,593,467 | A | | 1/1997 | Monroe | |
| 5,611,829 | A | | 3/1997 | Monroe | |
| 5,728,184 | A | * | 3/1998 | Monroe | 51/309 |
| 5,919,549 | A | | 7/1999 | Van | |
| 5,928,070 | A | * | 7/1999 | Lux | 451/526 |
| 6,017,831 | A | * | 1/2000 | Beardsley et al. | 442/68 |
| 6,080,482 | A | * | 6/2000 | Martin et al. | 428/373 |
| 6,302,930 | B1 | * | 10/2001 | Lux | 51/298 |
| 6,582,289 | B1 | * | 6/2003 | Eisenberg | 451/548 |
| 6,733,876 | B1 | * | 5/2004 | Beardsley et al. | 428/317.9 |
| 7,169,199 | B2 | * | 1/2007 | Barber et al. | 51/298 |
| 7,232,364 | B2 | * | 6/2007 | Hibbard | 451/526 |
| 7,985,269 | B2 | * | 7/2011 | Ludwig | 51/298 |
| 2002/0026752 | A1 | * | 3/2002 | Culler et al. | 51/298 |
| 2003/0024170 | A1 | * | 2/2003 | Larson et al. | 51/298 |
| 2005/0260387 | A1 | * | 11/2005 | Lux | 428/143 |
| 2006/0041065 | A1 | | 2/2006 | Barber, Jr. | |
| 2007/0023971 | A1 | * | 2/2007 | Saha et al. | 264/432 |
| 2008/0127572 | A1 | | 6/2008 | Ludwig | |
| 2008/0233850 | A1 | * | 9/2008 | Woo et al. | 451/526 |
| 2009/0077900 | A1 | * | 3/2009 | Chuda et al. | 51/309 |
| 2010/0130104 | A1 | * | 5/2010 | Everts et al. | 451/28 |

FOREIGN PATENT DOCUMENTS

| | | |
|---|---|---|
| WO | WO 98/10896 | 3/1998 |
| WO | WO 99/56913 | 11/1999 |
| WO | WO 01/23320 | 4/2001 |
| WO | WO 2006/127502 | 11/2006 |
| WO | WO 2008/070397 | 6/2008 |

* cited by examiner

CONVOLUTE ABRASIVE WHEEL AND METHOD OF MAKING

CROSS REFERENCE TO RELATED APPLICATIONS

This application is a national stage filing under 35 U.S.C. 371 of PCT/US2011/060752 filed Nov. 15, 2011, which claims priority to U.S. Provisional Patent Application No. 61/414,966, filed Nov. 18, 2010, the disclosures of which are incorporated by reference in their entirety herein.

BACKGROUND

Convolute abrasive wheels are made by spirally winding a nonwoven abrasive web about a core and then curing a binder to adhere the spirally wound layers to each other. Convolute abrasive wheels are useful for finishing different types of work pieces such as builder's hardware and plumbing fixtures.

SUMMARY

Typically, the abrasive grain used to make convolute abrasive wheels is a conventional lower cost mineral such as brown aluminum oxide. While it is generally known that premium abrasive grains, such as sol-gel derived alpha alumina, offer improved cut performance in coated or bonded abrasive articles, usage of premium abrasive grains in nonwoven abrasive articles has not been adopted by manufacturers. The main reason for not using such abrasive grains is that the cut performance has not enhanced when using the premium grain; however, the cost of the convolute abrasive wheel is significantly increased. Thus, the convolute abrasive wheel with premium abrasive grain is not commercially feasible since it costs more to make, but performs the same as the lower cost convolute abrasive wheel with brown aluminum oxide.

The inventor has discovered that by using two different size coatings when manufacturing the convolute abrasive wheel, the performance of the convolute abrasive wheel using premium abrasive grain is significantly increased. The increase in performance more than justifies the increased cost from using premium abrasive grain, such that the convolute abrasive wheel provides a significant value proposition for the eventual customer.

In particular, the inventor has discovered that by applying a first size coating comprising a phenolic resin over the nonwoven abrasive web and then partially curing the phenolic resin before applying a second size coating comprising a polyurethane resin, the performance advantage of the premium abrasive grain in the convolute abrasive wheel is unlocked. It is believed that the cured phenolic resin size coat enhances retention of the abrasive grain, thereby increasing the finishing performance of the convolute abrasive article. After application of the polyurethane resin, the nonwoven abrasive article is spirally wound and cured to form the convolute abrasive article.

Hence, in one embodiment, the invention resides in a convolute abrasive wheel comprising a spirally wound nonwoven abrasive web; the nonwoven abrasive web comprising a make coat and abrasive particles comprising a Vickers indentation hardness of at least 16 Gpa and a toughness of at least 3.0 Mpa $m^{1/2}$; a first size coat over the make coat and abrasive particles comprising a phenolic resin; and a second size coat over the first size coat comprising a polyurethane.

In another embodiment, the invention resides in a method of making a convolute abrasive wheel comprising the steps of: applying a make coating to a first major surface of a nonwoven web; applying abrasive particles to the make coat, the abrasive particles comprising a Vickers indentation hardness of at least 16 Gpa and a toughness of at least 3.0 Mpa $m^{1/2}$; applying a first size coating comprising a phenolic resin over the make coat and abrasive particles; partially curing at least the first size coat to make a nonwoven abrasive web; applying a second size coat comprising a polyurethane prepolymer resin over the cured first size coat; spirally winding the nonwoven abrasive web with the second size coat into a roll; and curing the first size coat and the second size coat to form the convolute abrasive wheel.

BRIEF DESCRIPTION OF THE DRAWINGS

It is to be understood by one of ordinary skill in the art that the present discussion is a description of exemplary embodiments only, and is not intended as limiting the broader aspects of the present disclosure, which broader aspects are embodied in the exemplary construction.

Repeated use of reference characters in the specification and drawings is intended to represent the same or analogous features or elements of the disclosure.

DEFINITIONS

As used herein, forms of the words "comprise", "have", and "include" are legally equivalent and open-ended. Therefore, additional non-recited elements, functions, steps or limitations may be present in addition to the recited elements, functions, steps, or limitations.

DETAILED DESCRIPTION

Figure 1:
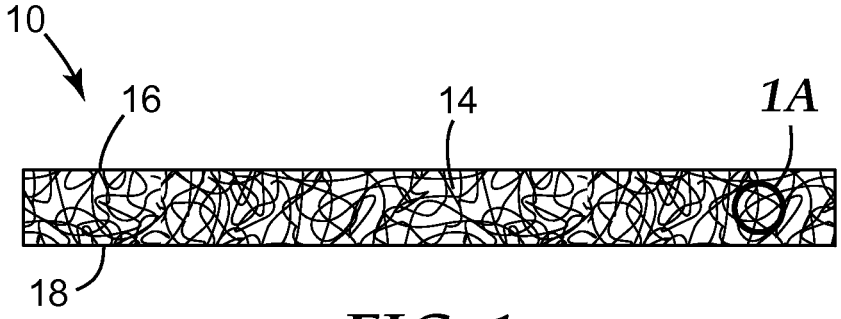
FIGS. 1 and 1A illustrate a nonwoven abrasive article having a cured first size coat comprising a phenolic resin applied to the nonwoven abrasive article and a second size coat comprising a polyurethane applied over the first size coat.
Figure 1A:
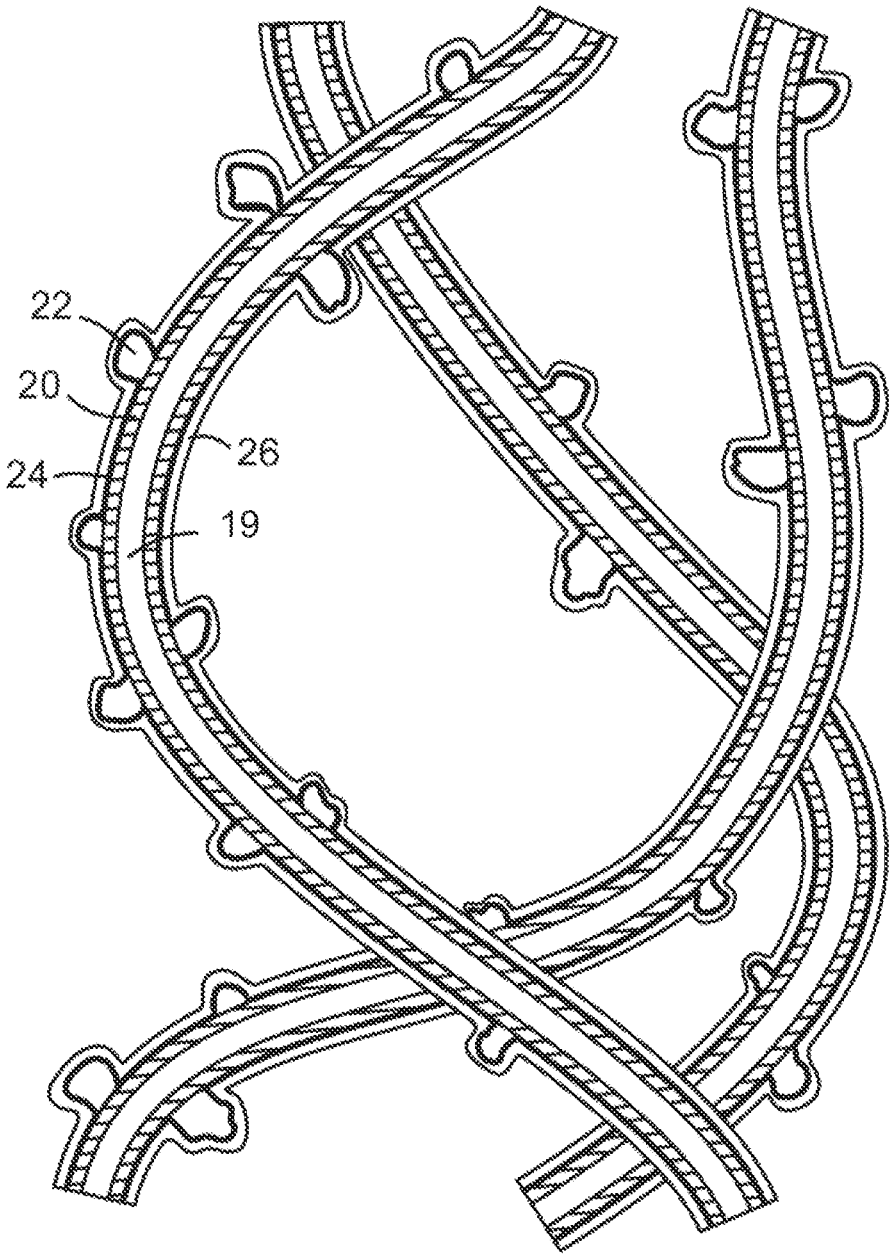

Referring to FIGS. 1 and 1A a nonwoven abrasive article 10 is illustrated. The nonwoven abrasive article includes a nonwoven web 14 having a first major surface 16 and a second major surface 18. In many embodiments, the nonwoven web 14 is a lofty, open, low-density, fibrous web that includes a plurality of fibers 19, several of which are more clearly illustrated in FIG. 1A. A make coat or first resin layer 20 comprising a curable resin is applied to the first or second major surfaces (16, 18) or to both surfaces, the make coat 20 coating at least some of the fibers 19 of the nonwoven web 14 as shown in FIG. 1A. Abrasive particles 22 are then applied either after the make coat 20 or simultaneously with the make coat 20. A first size coat 24 comprising a phenolic resin is applied over the make coat 20 and abrasive particles 22. Thereafter, the make coat 20 and the first size coat 24 are either partially cured together until the resins are no longer wet and tacky, or sequentially partially cured by individual application and heating of each layer prior to applying a second size coat 26 comprising a polyurethane.

Figure 2:
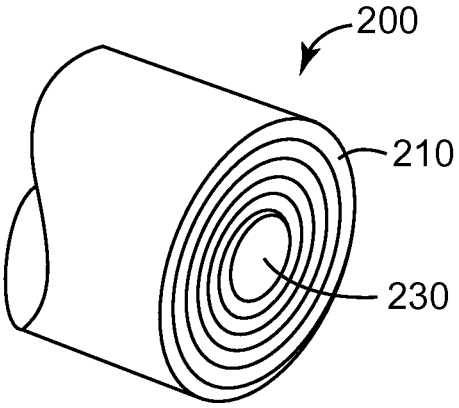
FIG. 2 illustrates a convolute abrasive article.

The nonwoven abrasive article comprising the partially cured first size coat 24 and uncured second size coat 26 is made into a convolute abrasive wheel by winding the nonwoven abrasive article of FIG. 1 under tension around a core member (e.g., a tubular or rod-shaped core member) such that the nonwoven layers become compressed. Then the second size coat 26 is cured binding the spiral wraps of the convolute abrasive wheel to each other. An exemplary convolute abrasive wheel 200 is shown in FIG. 2, wherein the nonwoven abrasive article 210 is spirally wound around and affixed to core member 230 and the second size coat 26 has been cured. If desired, convolute abrasive wheels may be dressed prior to use to remove surface irregularities, for example, using methods known in the abrasive arts.

In compressing the layers of impregnated nonwoven web during winding, the layers are typically compressed to form a bun having a density that is from 1 to 20 times that of the density of the nonwoven layers in their non-compressed state. The bun is then typically subjected to a batch heat cure (e.g., for from 2 to 20 hours) at elevated temperature (e.g., at 135° C.), typically depending on the polyurethane second size coat and bun size.

Nonwoven webs suitable for use in the convolute abrasive article are known in the abrasives art. Typically, the nonwoven web comprises an entangled web of fibers. The fibers may comprise continuous fiber, staple fiber, or a combination thereof. For example, the fiber web may comprise staple fibers having a length of at least about 20 millimeters (mm), at least about 30 mm, or at least about 40 mm, and less than about 110 mm, less than about 85 mm, or less than about 65 mm, although shorter and longer fibers (e.g., continuous filaments) may also be useful. The fibers may have a fineness or linear density of at least about 1.7 decitex (dtex, i.e., grams/10000 meters), at least about 6 dtex, or at least about 17 dtex, and less than about 560 dtex, less than about 280 dtex, or less than about 120 dtex, although fibers having lesser and/or greater linear densities may also be useful. Mixtures of fibers with differing linear densities may be useful, for example, to provide an abrasive article that upon use will result in a specifically preferred surface finish. If a spunbond nonwoven is used, the filaments may be of substantially larger diameter, for example, up to 2 mm or more in diameter.

The nonwoven web may be made, for example, by conventional air laid, carded, stitch bonded, spun bonded, wet laid, and/or melt blown procedures. Air laid fiber nonwoven webs may be prepared using equipment such as, for example, that available under the trade designation "RANDO WEBBER" commercially available from Rando Machine Company of Macedon, N.Y.

Nonwoven webs are typically selected to be compatible with adhering binders and abrasive particles while also being processed in combination with other components of the article, and typically can withstand processing conditions (e.g., temperatures) such as those employed during application and curing of the binder compositions. The fibers may be chosen to affect properties of the abrasive article such as, for example, flexibility, elasticity, durability or longevity, abrasiveness, and finishing properties. Examples of fibers that may be suitable include natural fibers, synthetic fibers, and mixtures of natural and/or synthetic fibers. Examples of synthetic fibers include those made from polyester (e.g., polyethylene terephthalate), nylon (e.g., hexamethylene adipamide, polycaprolactam), polypropylene, acrylonitrile (i.e., acrylic), rayon, cellulose acetate, polyvinylidene chloride-vinyl chloride copolymers, and vinyl chloride-acrylonitrile copolymers. Examples of suitable natural fibers include cotton, wool, jute, and hemp. The fiber may be of virgin material or of recycled or waste material, for example, reclaimed from garment cuttings, carpet manufacturing, fiber manufacturing, or textile processing. The fiber may be homogenous or a composite such as a bicomponent fiber (e.g., a co-spun sheath-core fiber). The fibers may be tensilized and crimped, and may also be continuous filaments such as those formed by an extrusion process. Combinations of fibers may also be used.

Prior to impregnation with the make coat, the nonwoven web typically has a weight per unit area (i.e., basis weight) of at least about 50 grams per square meter (gsm), at least about 100 gsm, or at least about 200 gsm; and/or less than about 400 gsm, less than about 350 gsm, or less than about 300 gsm, as measured prior to any coating (e.g., with the make coat or optional pre-bond resin), although greater and lesser basis weights may also be used. In addition, prior to impregnation with the make coat, the fiber web typically has a thickness of at least about 5 mm, at least about 6 mm, or at least about 10 mm; and/or less than about 200 mm, less than about 75 mm, or less than about 30 mm, although greater and lesser thicknesses may also be useful.

Further details concerning nonwoven abrasive articles, convolute abrasive wheels, and methods for their manufacture may be found, for example, in U.S. Pat. No. 2,958,593 (Hoover et al.); U.S. Pat. No. 4,486,200 (Heyer et al.); U.S. Pat. No. 5,591,239 (Larson et al.); U.S. Pat. No. 5,919,549 (Van et al.); U.S. Pat. No. 6,017,831 (Beardsley et al.); U.S. Pat. Appln. Publ. 2006/0041065 A 1 (Barber, Jr.); and U.S. Pat. Appln. Publ. 2008/0127572 A 1 (Ludwig).

Frequently, it is useful to apply a pre-bond resin to the nonwoven web prior to coating with the make coat. The pre-bond resin serves, for example, to help maintain the nonwoven web integrity during handling, and may also facilitate bonding of the make coat to the nonwoven web. Examples of prebond resins include phenolic resins, urethane resins, hide glue, acrylic resins, urea-formaldehyde resins, melamine-formaldehyde resins, epoxy resins, and combinations thereof. The amount of pre-bond resin used in this manner is typically adjusted toward the minimum amount consistent with bonding the fibers together at their points of crossing contact. In some embodiments, the prebond resin is cured by running through a tunnel oven at 345° F. for 3.4 minutes before applying the make coat. In cases where the nonwoven web includes thermally bondable fibers, thermal bonding of the nonwoven web may also be helpful to maintain web integrity during processing.

Examples of useful abrasive particles include any premium abrasive particles having an average Vickers indentation hardness of at least 16, at least 17, at least 18, or at least 19 Gpa. Vickers indention hardness can be tested as discussed in U.S. Pat. No. 5,593,467 to Monroe entitled "Abrasive Grain" at column 23, lines 39-48. Additionally, the abrasive particles have an average toughness of at least 3.0, at least 3.2, at least 3.5, at least 3.8, or at least 4.0 Mpa $m^{1/2}$. Average toughness is measured according to the test procedure outlined in the article "Equilibrium Penny-like Cracks in Indention Fracture," by Lawn and Fuller, *Journal of Material Science*, Volume 10, (1975), pp. 2016-24 incorporated herein by reference.

Useful premium abrasive particles include diamond abrasive particles, cubic boron nitride abrasive particles, and alpha alumina abrasive particles derived from sol-gel production methods, and mixtures thereof. The abrasive particles may be in the form of, for example, individual particles, agglomerates, composite particles, and mixtures thereof. Blends of premium abrasive particles and conventional abrasive particles can be used; however, at least 15%, at least 30%, at least 50%, at least 70%, or at least 90% of the blend should comprise the premium abrasive particles. In some embodiments, 100% of the abrasive particles used in the convolute abrasive wheel are premium abrasive particles.

The abrasive particles may, for example, have an average diameter of at least about 0.1 micrometer, at least about 1 micrometer, or at least about 10 micrometers, and less than about 2000, less than about 1300 micrometers, or less than about 1000 micrometers, although larger and smaller abrasive particles may also be used.

For example, the abrasive particles may have an abrasives industry specified nominal grade. Such abrasives industry accepted grading standards include those known as the American National Standards Institute, Inc. (ANSI) standards, Federation of European Producers of Abrasive Products (FEPA) standards, and Japanese Industrial Standard (JIS) standards. Exemplary ANSI grade designations (i.e., specified nominal grades) include: ANSI 4, ANSI 6, ANSI 8, ANSI 16, ANSI 24, ANSI 36, ANSI 40, ANSI 50, ANSI 60, ANSI 80, ANSI 100, ANSI 120, ANSI 150, ANSI 180, ANSI 220, ANSI 240, ANSI 280, ANSI 320, ANSI 360, ANSI 400, and ANSI 600. Exemplary FEPA grade designations include P8, P12, P16, P24, P36, P40, P50, P60, P80, P100, P120, P150, P180, P220, P320, P400, P500, 600, P800, P1000, and P1200. Exemplary JIS grade designations include HS8, JIS12, JIS16, JIS24, JIS36, JIS46, JIS54, JIS60, JIS80, JIS100, JIS 150, JIS 180, JIS220, JIS 240, JIS280, JIS320, JIS360, JIS400, JIS400, JIS600, JIS800, JIS1000, JIS1500, JIS2500, JIS4000, JIS6000, JIS8000, and JIS10000.

Typically, the coating weight for the abrasive particles may depend, for example, on the particular curable make coat used, the process for applying the abrasive particles, and the size of the abrasive particles. For example, the coating weight of the abrasive particles on the nonwoven web (before any compression) may be at least 200 grams per square meter (g/m), at least 600 g/m, or at least 800 g/m; and/or less than 2000 g/m, less than about 1600 g/m, or less than about 1200 g/m, although greater or lesser coating weights may be also be used.

Examples of useful make coat resins include resole phenolic resins which are base-catalyzed and have a molar ratio of formaldehyde to phenol of greater than or equal to 1:1; typically within a range of about 1.5:1 to about 3:1. The first size coat 24 comprises the resole phenolic resin. Examples of commercially available resole phenolic resins include those known by the trade names "Durez" from Sumitomo Bakelite Co., "Durite" from Hexion Specialty Co. and "Prefere" from Arclin Canada Co. Typically, the coating weight for the first size coat is at least 6% of the abrasive particle coating weight, at least 10% of the abrasive particle coating weight, or at least 14% of the abrasive particle weight; and/or less than 28% of the abrasive particle coating weight, or less than about 20% of the abrasive particle coating weight. The first size coat 24 is partially cured until the coating is no longer tacky prior to application of the second size coat 26. Partial curing of the first size coat is done in one embodiment by running the coated nonwoven web through a tunnel oven at 121° C. (250° F.) for 2.7 minutes.

The second size coat 26 comprises a polyurethane resin after curing. Useful polyurethane prepolymer resins contain a free isocyante content of between 4.0% to 8.0% and are cured with a diamine curative. Examples of commercially available prepolymer polyurethane resins are known by the trade names of "Adiprene" from Chemtura Corp. and "Desmodur" from Bayer Materials Science.

Typically, the second size coat 26 is dried or partially cured prior to winding the nonwoven abrasive web into a roll. This is accomplished in one embodiment by running the coated web through a tunnel oven at 41° C. (105° F.) for 2.7 minutes. The second size coat 26 is fully cured after spirally winding the nonwoven abrasive web around a core. Curing of the spirally wound web, in one embodiment, is conducted by pulling heated air in one axial end of the spirally wound coated nonwoven web, through the spirally wound coated nonwoven web and out the opposite axial end. Curing is accomplished by using heated air between 82° C. (180° F.) and 92° C. (200° F.) for 6 hours and then increasing the temperature to 113° C. (235° F.) for an additional 9 hours.

EXAMPLES

Objects and advantages of this disclosure are further illustrated by the following non-limiting examples. The particular materials and amounts thereof recited in these examples as well as other conditions and details, should not be construed to unduly limit this disclosure. Unless otherwise noted, all parts, percentages, ratios, etc. in the Examples and the rest of the specification are by weight.

Example 1 and Comparative Examples A-C

Example 1 and Comparative Examples A-C were prepared to demonstrate the effectiveness of the inventive convolute abrasive wheel having a premium abrasive grain and a cured first size coat of phenolic prior to application of the polyurethane second size coat. The nonwoven abrasive web of Example 1 and Comparative Examples A-C were prepared in the sequence shown in Table 3 from materials identified in Table 1 and Table 2. The resulting nonwoven abrasive web bearing a partially-dried yet uncured second size coating 26 was wrapped around the circumference of an 8.57 cm (3.375 inch) diameter, 0.476 cm (0.1875 inch) wall thickness, fiberglass cylindrical core bearing an uncured adhesive. Spiral wraps of coated nonwoven web were wound around the core under tension and with a pressure roll urging each wrap in position until the outer diameter of the wound nonwoven abrasive web and core, hereafter referred to as a "bun", was approximately 17.8 cm (7.0 inch). The bun was then placed in a batch oven and the second size coating 26 was cured as described in Table 3. The bun was mounted on a lathe and the outer diameter of the bun reduced to approximately 16.5 cm (6.5 inch) with a diamond point tool. The bun was then cut with a diamond saw perpendicular to the axis of the core to form several convolute abrasive wheels measuring approximately 16.5 cm (6.5 inch) diameter, 2.5 cm (1.0 inch) wide, with a 7.6 cm (3.0 inch) center hole. Material densities of the resulting abrasive articles, excluding the fiberglass core, were between 0.61 g/cm$^3$ (0.22 lb/in$^3$) and 0.73 g/cm$^3$ (0.26 lb/in$^3$).

Materials

TABLE 1

| Abbreviation | Description |
|---|---|
| xylol | solvent, obtained from Canada Color and Chemicals, Ltd, Brampton, Ontario, Canada |
| K450PM | 42.3% amine curing agent, obtained from Royce International, East Rutherford, New Jersey as "LAPOX K-450" in PMA |
| BL16 | polyurethane prepolymer, obtained from Chemtura, Middlebury, |

TABLE 1-continued

| Abbreviation | Description |
|---|---|
| | Connecticut, as "ADIPRENE BL-16" |
| R202 | fumed silica, obtained from Evonik DeGussa Corporation, Vernon Hills, Illinois as "AEROSIL R202" |
| PR | phenolic resin, obtained from Arclin Canada, Ltd, North Bay, Ontario, Canada, as "PREFERE 5077A" |
| water | tap water |
| Dynol | surfactant, obtained from Air Products and Chemicals, Inc., Allentown, Pennsylvania, as "DYNOL 604" |
| PME | propylene glycol monomethyl ether acetate, obtained from Sigma Aldrich, St. Louis, Missouri as "DOWANOL PMA" |
| SR511 | hydroxyethyl ethylene urea (75% in water), obtained from Sartomer Company, Inc., Exton, Pennsylvania as "SR-511A" |
| PMA | 1-methoxy-2-propanol acetate, obtained from Lyondell Chemical Company, Houston, Texas as "ARCOSOLV PM Acetate" |
| LiSt | lithium stearate powder, obtained from Crompton Corporation, Greenwich, Connecticut as "lithium stearate PM" |
| LiPM | 45% LiSt in PMA |
| BL31 | polyurethane prepolymer, obtained from Chemtura, Middlebury, Connecticut, as "ADIPRENE BL-31" |
| BAO | brown aluminum oxide abrasive particles, grade 100, obtained from Washington Mills Electro Minerals Corporation, Niagra Falls, New York, as "DURALUM" |
| 321 | sol-gel derived ceramic alpha alumina abrasive particles, grade 100, obtained from 3M, Saint Paul, Minnesota, as "CUBITRON 321" |
| MDA | 4,4'-methylene dianiline, obtained from Aceto Corporation, Lake Success, New York as "3602800" |
| MDAPM | 35% MDA in PMA |
| AF | silicone antifoam, obtained from Dow Corning, Midland, Michigan as "Antifoam 1520-US" |
| PAF | polyamide staple fiber, 15 denier × 1.5 in (16.67 dtex × 38 mm), obtained from Invista SARL, Wichita, Kansas as "INVISTA 6-6 Nylon" |
| Pigment | colorant, obtained from Milliken Chemicals, Spartanburg, South Carolina as "REACTINT Violet" |

Abrasive Efficiency Test

Convolute abrasive wheels comprising the inventive and comparative samples were tested according to the Abrasive Efficiency test. The wheels were mounted on a 3.17 cm (1.25 inch) diameter driven shaft with 7.6 cm (3.0 inch) outer diameter by 3.17 cm (1.25 inch) inner diameter flanges. Two test specimens were prepared for each nonwoven abrasive composition to be tested. Each test specimen was evaluated for abrasiveness against an 11 inch (28 cm)×2 inch (5 cm)×0.056 inch (1.4 mm) perforated carbon steel screen plate workpiece (5/32 inch (0.40 cm) hole diameter on 7/32 inch (0.56 cm)) centers staggered pattern on 1008 cold rolled steel, stock pattern 401 obtained from Harrington & King Company, Chicago, Ill. Test specimens were rotated at 5500 ft/min (1676 m/min) and urged against the workpiece at 5 pound per linear inch (875 Newton per linear meter) force. A single test run had 15 cycles of contacting the test specimen against the plate workpiece for 15 seconds followed by retracting the plate workpiece from the test specimen for 10 seconds. A new plate workpiece was mounted and the single test run was repeated four times with a new plate workpiece for each run. The before-test weight and the after-test weight of both the test specimen and the five plate workpieces were recorded. The Total Cut of an abrasive wheel is calculated as follows and indicates the aggressiveness of the wheel:

$$TotalCut = \sum_{i=1}^{5} (PlateWeightBeforeTestRun_i - PlateWeightAfterTestRun_i)$$

The Efficiency % is used to indicate the performance of the abrasive wheel and is calculated as follows:

$$\text{Efficiency \%} = \frac{TotalCut}{\left(\frac{SpecimenWeightBeforeTestRun1 - SpecimenWeightAfterTestRun5}{SpecimenWeightBeforeTestRun1}\right) * 100}$$

A larger magnitude for Efficiency % indicates a better performing abrasive wheel given similar levels of Total Cut.

Coating Compositions

TABLE 2

| | Parts by weight | | | | | |
|---|---|---|---|---|---|---|
| Material | RC1 | RC1B | RC2 | SpC1 | SC1 | SC1B |
| xylol | 8.00 | 4.00 | | | | |
| K450PM | | 5.22 | | | | 10.92 |
| BL16 | 10.72 | 14.33 | | | | |
| R202 | | 0.38 | | | | |
| PR | | | 22.01 | 15.29 | | |
| water | | | 11.50 | 6.61 | | |
| Dynol | | | 0.03 | | | |
| PME | | | | 1.18 | | |
| SR511 | | | | 1.92 | | |
| PMA | | | | | 2.43 | 14.25 |
| LiPM | | | | | 1.07 | 1.42 |
| BL31 | | | | | 18.31 | 24.42 |
| MDAPM | 3.95 | | | | 8.19 | |
| AF | 0.01 | 0.01 | | | | |
| Pigment | | 0.124 | | | | |

TABLE 3

| Component | Example 1 composition | Example 1 add-on, g/m$^2$ | Comparative A composition | Comparative A add-on, g/m$^2$ | Comparative B composition | Comparative B add-on, g/m$^2$ | Comparative C composition | Comparative C add-on, g/m$^2$ |
|---|---|---|---|---|---|---|---|---|
| fiber web | PAF | 88.0 | PAF | 88.0 | PAF | 92.1 | PAF | 92.1 |
| prebond coating | RC1 | 58.7 | RC1 | 58.7 | RC1B | 54.47 | RC1B | 54.47 |
| cure | 8 ft/min (2.4 m/min) through a 8.2 m oven set at 345 degrees F. (174 degrees C.) | | | | | | | |
| make coating | RC2 | 146.6 | RC2 | 146.6 | RC2 | 155.0 | RC2 | 155.0 |
| mineral coating | 321 | 984.6 | 321 | 984.6 | BAO | 988.8 | BAO | 988.8 |
| cure | 10 ft/min (3 m/min) through a 8.2 m oven set at 250 degrees F. (121 degrees C.) | | | | | | | |
| first size coating (2 passes) | SpC1 | 142.4 | none | none | SpC1 | 134.1 | none | none |
| cure | 10 ft/min (3 m/min) through a 8.2 m oven set at 290 degrees F. (143 degrees C.) | | | | | | | |
| second size coating | SC1 | 356.1 | SC1 | 364.5 | SC1B | 268.2 | SC1B | 356.2 |
| dry | 8 ftm/min (2.4 m/min) through an 8.2 m oven set at 105 degrees F. (41 degrees C.) | | | | | | | |

| | Example 1 | Comparative A | Comparative B | Comparative C |
|---|---|---|---|---|
| spirally wind | described above | | | |
| Batch oven cure | Batch oven cure for 6 hours at 200 degrees F. (93 degrees C.) followed by 9 hours at 235 degrees F. (113 degrees C.) | Batch oven cure for 3 hours at 200 degrees F. (93 degrees C.) followed by 9 hours at 235 degrees F. (113 degrees C.) | Batch oven cure for 6 hours at 180 degrees F. (82 degrees C.) followed by 9 hours at 235 degrees F. (113 degrees C.) | Batch oven cure for 6 hours at 180 degrees F. (82 degrees C.) followed by 9 hours at 235 degrees F. (113 degrees C.) |
| cut into wheels | described above | | | |
| Cut/Wear Test results, | | | | |
| Efficiency % | 40.1% | 29.8% | 22.3% | 27.2% |
| (std. Dev.) | (2.390) | (1.204) | (4.355) | (1.241) |
| Total Cut g | 78.56 g | 86.1 g | 41.13 g | 39.63 g |
| (std. Dev.) | (9.22) | (4.27) | (1.27) | (1.66) |

As seen in Example 1 in Table 3, when premium abrasive particles (ceramic alpha alumina) and a partially cured phenolic resin as a first size coat are employed to make the convolute abrasive wheel, the Efficiency % of the convolute abrasive wheel is 40.1% as compared to Comparative Example C at 27.2% produced with conventional brown aluminum oxide particles and without a phenolic resin first size coat. This is a surprising increase in the performance of the convolute abrasive wheel. Comparative Example A shows that elimination of the partially cured phenolic resin first size coat when using ceramic alpha alumina abrasive particles resulted in a convolute abrasive wheel having nearly the same performance as Comparative Example C (29.8% versus 27.2%). Comparative Example B shows that using a partially cured phenolic resin first size coat in combination with conventional brown aluminum oxide mineral resulted in a convolute abrasive wheel having decreased performance as Comparative Example C (22.3% versus 27.2%). Thus, the partially cured phenolic first size coat significantly increases the performance of alpha alumina premium abrasive grain and actually decreases the performance of conventional brown aluminum oxide abrasive grain.

Other modifications and variations to the present disclosure may be practiced by those of ordinary skill in the art, without departing from the spirit and scope of the present disclosure, which is more particularly set forth in the appended claims. It is understood that aspects of the various embodiments may be interchanged in whole or part or combined with other aspects of the various embodiments. All cited references, patents, or patent applications in the above application for letters patent are herein incorporated by reference in their entirety in a consistent manner. In the event of inconsistencies or contradictions between portions of the incorporated references and this application, the information in the preceding description shall control. The preceding description, given in order to enable one of ordinary skill in the art to practice the claimed disclosure, is not to be construed as limiting the scope of the disclosure, which is defined by the claims and all equivalents thereto.

What is claimed is:

1. A convolute abrasive wheel comprising a spirally wound nonwoven abrasive web, the nonwoven abrasive web comprising:

a nonwoven web including a plurality of fibers, a make coat and abrasive particles applied to the nonwoven web, wherein the abrasive particles comprise a Vickers indentation hardness of at least 16 Gpa and a toughness of at least 3.0 Mpa m$^{1/2}$, a first size coat over the make coat and abrasive particles comprising a phenolic resin, and a second size coat over the first size coat comprising a polyurethane.

2. The convolute abrasive wheel of claim 1 wherein the abrasive particles comprise ceramic alpha alumina.

3. A method of making a convolute abrasive wheel comprising the steps of:

applying a make coat to a first major surface of a nonwoven web, wherein the nonwoven web comprises a plurality of fibers, and further wherein the step of applying the make coat to the first major surface of the nonwoven web includes the make coat coating at least some of the fibers;

applying abrasive particles to the make coat, the abrasive particles comprising a Vickers indentation hardness of at least 16 Gpa and a toughness of at least 3.0 Mpa $m^{1/2}$;

applying a first size coat comprising a phenolic resin over the make coat and abrasive particles;

partially curing at least the first size coat to make a nonwoven abrasive web;

applying a second size coat comprising a polyurethane prepolymer resin over the cured first size coat;

spirally winding the nonwoven abrasive web with the second size coat into a roll; and curing the first size coat and the second size coat to form the convolute abrasive wheel.

4. The method of claim 3 wherein prior to the applying a make coat to the nonwoven web, a prebond coating is applied to the nonwoven web and the prebond coating is cured prior to application of the make coat.

5. The method of claim 3 wherein after the applying abrasive particles to the make coat, the make coat is partially cured prior to application of the first size coat.

6. The method of claim 3 wherein after the applying the second size coat to the nonwoven abrasive web the second size coat is partially cured prior to spirally winding the nonwoven abrasive web.

* * * * *

UNITED STATES PATENT AND TRADEMARK OFFICE

CERTIFICATE OF CORRECTION

PATENT NO. : 9,079,294 B2
APPLICATION NO. : 13/882564
DATED : July 14, 2015
INVENTOR(S) : Dean Holmes It is certified that error appears in the above-identified patent and that said Letters Patent is hereby corrected as shown below:

On the Title Page, in Column 2, under the (Abstract)
Line 6, after "abrasive" insert -- particles. A second size coat comprising a polyurethane --.

Signed and Sealed this
Ninth Day of February, 2016

Michelle K. Lee

Michelle K. Lee
*Director of the United States Patent and Trademark Office*